US005346259A

United States Patent [19]

Mocilnikar et al.

[11] Patent Number: 5,346,259

[45] Date of Patent: Sep. 13, 1994

[54] ANTI-THEFT LABEL CONSTRUCTION

[75] Inventors: Anton Mocilnikar, Cleveland; Charles K. Herrmann, Cleveland Heights, both of Ohio

[73] Assignee: Avery Dennison Corporation, Pasadena, Calif.

[21] Appl. No.: 914,979

[22] Filed: Jul. 16, 1992

[51] Int. Cl.[5] ..... B42D 15/00

[52] U.S. Cl. ..... 283/108; 283/81; 283/94

[58] Field of Search ..... 283/81, 94, 98, 100, 283/101, 108; 40/299, 625, 626, 630; 428/40–43

[56] References Cited

U.S. PATENT DOCUMENTS 3,631,617 1/1972 Pekko .
3,864,855 2/1975 Pekko et al. ..... 40/2.2
3,973,788 8/1976 Pekko et al. .
4,121,003 10/1978 Williams .
4,268,983 5/1981 Cook .
4,608,288 8/1986 Spindler .
4,721,638 1/1988 Matsuguchi et al. .
4,746,556 5/1988 Matsuguchi et al. .
5,042,842 8/1991 Green et al. .

*Primary Examiner*—Timothy V. Eley
*Assistant Examiner*—Willmon Fridie, Jr.
*Attorney, Agent, or Firm*—Poms, Smith, Lande & Rose

[57] ABSTRACT

The present invention is a tamper proof label comprised of a thicker support portion and a thinner fragile portion. The label is formed of a plurality of layers of varnish, adhesive, plastic, and ink. The label incorporates an authentication region in which the text can be readily deciphered only with a special viewer. The top surface of the label can be written on with ink and is difficult to erase without destroying the fragile portion of the label. The label is adhered to a product by an adhesive which becomes aggressively bonded to the product over a relatively short period of time. In addition, the adhesive leaves a residue which is visible when illuminated with ultraviolet light.

19 Claims, 3 Drawing Sheets

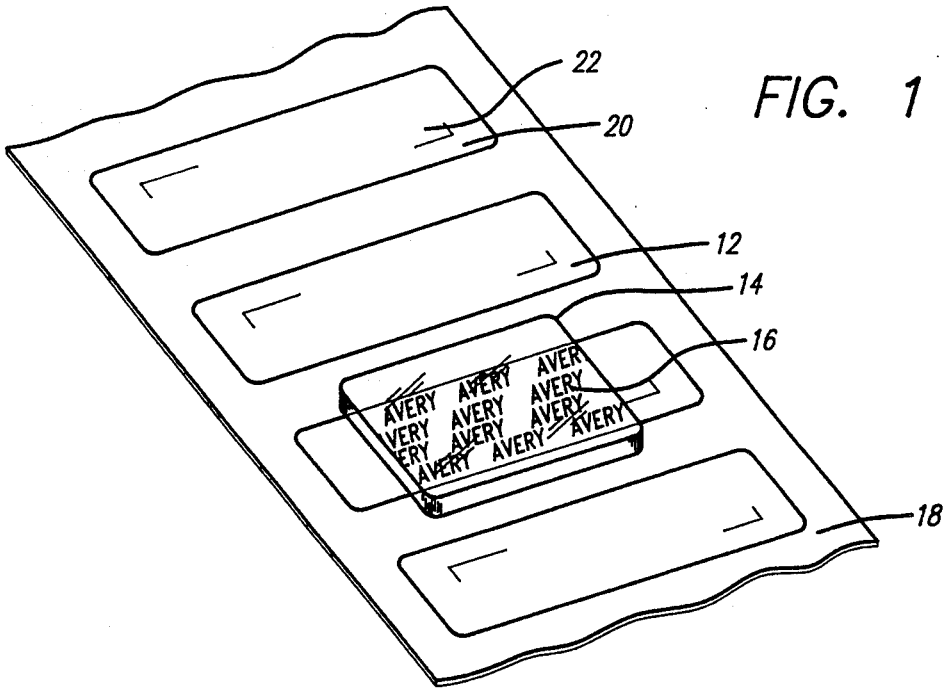
FIG. 1
FIG. 2
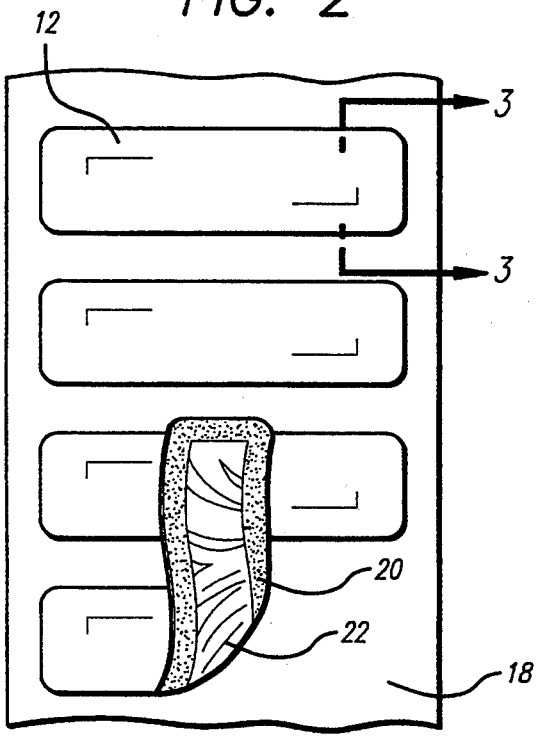
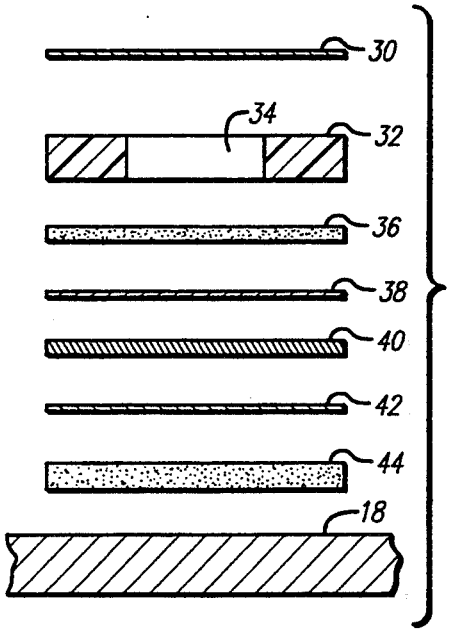
FIG. 3

ANTI-THEFT LABEL CONSTRUCTION

FIELD OF THE INVENTION

The present invention generally relates to labels, more particularly to tamper proof labels which deform if removed from an article of which the label is placed.

BACKGROUND OF THE INVENTION

Labels are used throughout our society. Stores place labels on goods to be sold indicating price and/or identifying the associated goods by a stock number. Uniform product codes (UPC) are frequently placed on labels or directly on goods to identify the goods. Transferring price labels from one item to another is a constant problem faced by store owners, especially in retail areas where customers may switch labels to pay a lower price for the goods.

Label integrity is also vital in the pharmaceutical industry. Switched labels or mismarked product can cause devastating or fatal results. There is also a trend to permanently mark automotive parts in order to control the use of stolen parts in auto repair work and reduce auto theft. Other industries and products also need labels which maintain label integrity to provide permanent marking and prevent label switching.

Counterfeit products which display a trademark belonging to an authentic manufacturer have infiltrated the marketplace of various industries, including the automobile industry. Manufacturers desire tamper proof packaging, labels, or other indicia of authentication which cannot be readily and cheaply copied by a counterfeiter.

Numerous label designs have attempted to create tamper proof labels which provide an indication of authentication yet is versatile in usage, allowing the label to be selectively affixed to goods, and allowing the label to be written upon.

U.S. Pat. No. 4,268,983 issued to Cook describes a label which has a heat softenable film attached to a support sheet. Both the support sheet and the heat softenable film have a lower adhesive layer located between the product and the label. When the label is removed, the heat softenable sheet is supposed to tear, separating from the support sheet. The top of the heat softenable film may be imprinted with a latent retro-reflective image. Cook requires a heat softenable layer which must be heated or melted to achieve the necessary configuration. The retro-reflective image is applied to specific selected areas and requires at least two different layers, at least one of which is reflective which causes the image and background areas to have different reflective efficiencies. Applying the retro-reflective image is difficult and expensive. Removing the label may also remove the retro-reflective layer preventing authentication if the product is returned.

U.S. Pat. No. 5,042,842 issued to Green employs a multi-layer label consisting of a lower sheet of safety paper and an upper sheet. The lower sheet of safety paper is attached by a permanent adhesive to a product. The upper sheet is attached by a patterned adhesive layer to the lower safety paper layer. Graphics and price information are printed on the top of the upper sheet. Indicia of authentication are printed on the bottom surface of the upper sheet. Authentication requires that the upper portion of the label including the upper sheet be separated from the lower safety paper sheet. Once separated, the layers cannot be rejoined to reconstitute the label. In addition, removal of the top portion is required in order to tell if an additional label has been placed over the top of the upper portion of the label. If the product is subsequently returned, only the lower layer of safety paper will be present on the product. No indicia of authentication is available to authenticate the product at that point.

U.S. Pat. No. 4,721,638 issued to Matsuguchi employs a similar multiple-layer configuration. A top layer is employed which is made of paper. A middle layer consisting of an aggressive adhesive layer is placed between the top paper layer and a bottom paper layer. Printing is applied to the top surface of the top layer, and to the bottom surface of the bottom layer. A bottom layer of adhesive is located in between the bottom of the bottom layer and the product to which the label is affixed. This adhesive layer is weaker than the aggressive middle adhesive layer located between the top layer and the bottom layer of paper. This type of label also requires removal of the label to authenticate the label by viewing the printing located on the bottom of the bottom layer, if it is visible through the lower adhesive layer, or a portion thereof that remains attached to the bottom layer of the label. If the product is returned, no part of the label will be present on the product to authenticate the product. This label may be moved from one product to another without destroying or deforming the label.

U.S. Pat. No. 4,746,556 issued to Matsuguchi describes a label which is also formed of multiple layers. The label consists of a top and bottom layer. Once adhered to a product, any attempt to remove the label will result in the removal of the top layer and a patterned portion of the bottom layer which is characterized as breakable. Portions of the bottom layer will be adhered to the top layer and portions of the bottom layer will remain adhered to the product. Several adhesives of differing strengths are applied in a patterned configuration between the top and bottom layers which causes the bottom layer to break in a predetermined pattern conforming to the pattern of the adhesives applied.

U.S. Pat. No. 4,608,288 issued to Spindler describes a label formed using an outer layer of material which is easily breakable or irreversibly stretchable under tension which is adhesively bonded on top of an intermediate layer. The outer layer of material extends beyond the intermediate layer. The intermediate layer may contain images which authenticate the label. Once the outer layer is removed, the authentication layer is exposed, making further authentication upon return of a product difficult. One version of this label is designed with light refracting properties allowing detection of mechanical stress which has been applied to the label. This version may also become deformed by resting weight on the label, such as by stacking products, and is especially vulnerable when used in automotive applications.

SUMMARY OF THE INVENTION

Tamper proof labels can provide the security necessary to prevent or detect label switching. In addition, adding features to tamper proof labels which provide an indicia of authentication which is not easily copied provides an additional level of protection against counterfeit goods, or counterfeit labels. The labels should not be unduly restrictive in the scope of their usage. Because of the structure of the labels of the present invention, they can resist efforts to introduce counterfeit goods, or counterfeit labels. The label of the present invention comprises a fragile easily tearable segment and a more sturdy support structure. The label includes an image which is visible only with the aid of a specially designed authentication viewer. The label can be written upon, including writing directly over the image area without damaging the image.

In accordance with one illustrated embodiment, the label includes a first layer formed of a clear varnish, a second layer formed of a clear plastic film, a third adhesive layer, a fourth varnish layer, a fifth authentication layer, a sixth primer layer, and a seventh adhesive layer affixed to a paper liner with a release coating to allow removal therefrom. In accordance with the broadest aspects of the present invention, the label may include a label formed with an aggressive adhesive layer on the back of the label in order to permanently adhere to goods, such as automotive parts.

Once the label of the present invention has been affixed to a product, or goods, it becomes permanently attached. Any attempt to remove the label will cause the fragile portion of the label to tear away from the support structure. Thus, the support structure is removed, leaving a portion of the label attached to the product or goods. The portion of the label attached to the support structure becomes unusable without the missing torn segment, thus protecting the product or goods from label switching.

The imprinted pattern on the upper surface of the label provides an additional defense to attempts to match portions of different labels in order to create the appearance of a valid label. The image area is not readily visible without an authentication viewer. This makes it difficult for someone substituting labels to know the image pattern on the surface of the label. Additionally, as the labels are manufactured, the location of the images on the surface of the label varies from label to label. This makes it unlikely that the support structure of one label can be superimposed upon, and match the image of the fragile segment of another label.

The graphics pattern imprinted on the top surface of the label also makes the label of the present invention difficult to copy without sophisticated equipment. The required investment in sophisticated label producing equipment reduces the likelihood that counterfeiters will reproduce labels which conform to the present design.

It is therefore an object of the present invention to provide a label which is tamper proof so that any removal or replacement of the label is readily detectable.

It is a further object of the present invention to provide a label which contains an indicia of authentication which can be used to detect overlaying of multiple labels.

It is a further object of the present invention to provide a tamper proof label which is applied to goods in the same manner as would be any other label.

It is a further object of the present invention to provide a tamper proof label which, when initially applied to a product, can be removed without damage to the label, to accommodate accidental mismarking which may occur.

It is a further object of the present invention to provide a tamper proof label which can be readily written upon, and to allow usage without restricting the text on the label to pre-printed material only.

DESCRIPTION OF THE DRAWINGS

FIG. 1 is a perspective view of several labels on a backing sheet and also shows the use of the sectional glass.

FIG. 2 is a front view of several labels on a backing sheet showing one label folded back to illustrate the relative weakness of a portion of the label.

FIG. 3 is a side cross-sectional view of the label.

DETAILED DESCRIPTION OF THE PREFERRED EMBODIMENT

Figure 4:
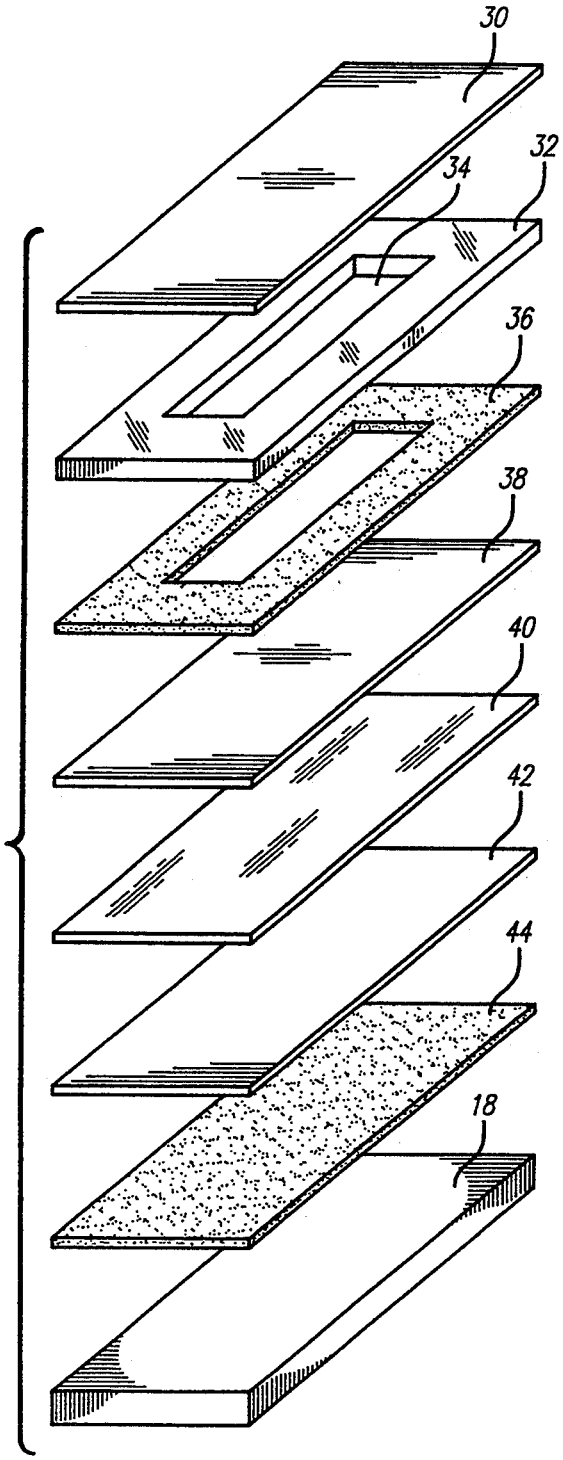
FIG. 4 is a perspective view of the composition of one embodiment of the present invention.
Figure 5:
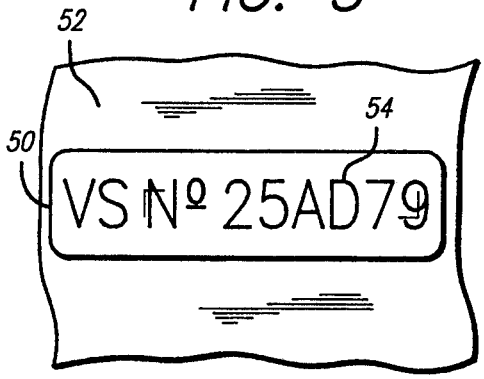
FIG. 5 is a front view of a label affixed to goods.

The present invention is produced as individual labels which are provided on a backing sheet. The labels are individually removed and replaced on a product by a manufacturer or retailer. FIG. 1 illustrates a typical sheet of labels. Individual labels 12 are located on backing sheet 18. An authentication pattern 16 shown as the word "Avery" is repeated on the surface of label 12. A second authentication pattern (not shown) is also imprinted on the label.

Authentication pattern 16 is visible only when authentication viewer 14 is placed over label 12. Authentication viewer 14 is a transparent piece of plastic or glass. The bottom of authentication viewer 14 has a series of grooves cut into it. These grooves selectively allow the image to be viewed through the plastic or glass, thus making the authentication pattern visible through the authentication viewer 14. Moving the authentication viewer 14 slightly along the label alternately allows viewing of the first "Avery" portion and a second authentication portion ("valid," not shown).

Label 12 is formed to create an outer support layer 20 which surrounds a fragile inner layer 22. These layers are more clearly visible in FIG. 2 as shown by the bottom label 12 on sheet 18 which has been partially raised off of sheet 18. The inner fragile layer 22 is significantly thinner than the support layer 20.

Figure 8:
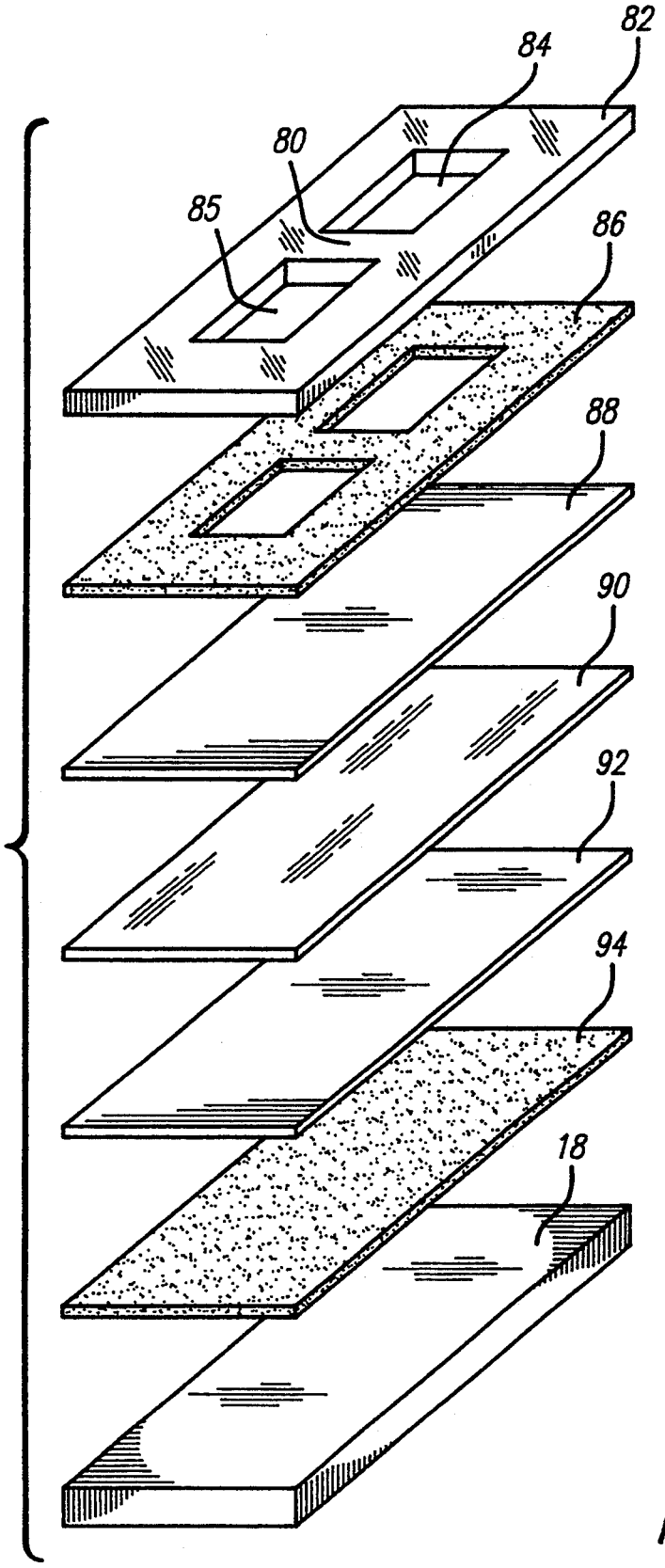
FIG. 8 is a perspective view of the composition of another embodiment of the present invention.

Referring now to FIGS. 3, 4 and 8 an ultraviolet curing matt varnish 30 forms the top layer of the label. This ultraviolet curing matt varnish will accept thermal transfer or dot matrix ribbon printing, as well as various inking instruments once it has cured. Ultraviolet curing matt varnish is available from Avery Dennison, Base Materials Unit of Monrovia, Calif., as No. 519 Fasson base material.

The ultraviolet matt curable varnish 30 is placed over a clear layer of polyethylene teraphthalate (PET) film 32. The clear PET film layer 32 is shaped to form a tamper window 34 as shown in FIG. 3. The PET film 32 is formed in the desired pattern to create support layer 20 (as shown in FIG. 2). A layer of PET film 2 mils. thick is preferred, and is available from ICI of Wilmington, Del. under the name Melinex type 442.

The PET layer is placed over a clear acrylic adhesive layer 36. A tab 80, shown in FIG. 8 may be employed to provide additional support to the label to prevent accidental or unintended tearing of the label. Clear acrylic adhesive is available from Avery Dennison of Monrovia as "clear acrylic adhesive, P-9." Comparable compounds are available in the industry. The clear acrylic adhesive layer 36 is preferably die cut to conform to the configuration of the PET film 32.

Underneath clear acrylic adhesive layer 36 is a patterned destrux varnish 38. Avery Dennison Destrux Varnish 50301A is acceptable.

A line scrambled "GENU-GRAPHIC" indicia 40 is located below the patterned destrux varnish 38. The "GENU-GRAPHIC" indicia allows text to be printed on the label which is only viewable with a "GENU-GRAPHIC" viewer which acts as a deciphering lens. Two different graphics messages can be printed in this manner. FIG. 1 illustrates the Avery pattern 16 which is viewable through the authentication viewer 14. Moving the authentication viewer 14 along the length of label 12 allows an observer to view the alternate line of graphics (not shown). This second line of graphics may be the word "valid" repeated in the same manner as the "Avery" pattern 16, or may be any other text desired. Graphics Security Systems of Lakeland, Florida licenses the use of Genu-Graphic indicia which is covered by U.S. Pat. Nos. 3,937,565, 4,092,654, and 4,198,147.

Figure 6:
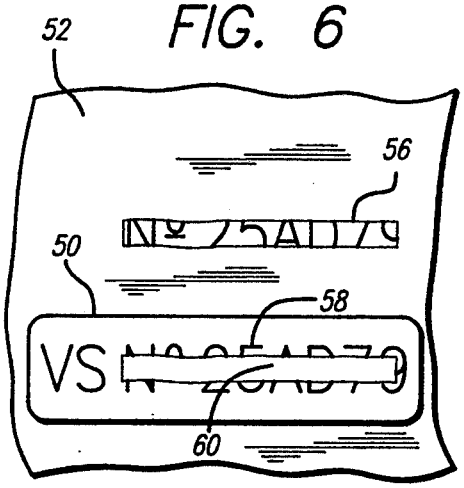
FIG. 6 is a front view of a label affixed to goods in which the support layer has been pealed away from the goods, leaving the weakened area.
Figure 7:
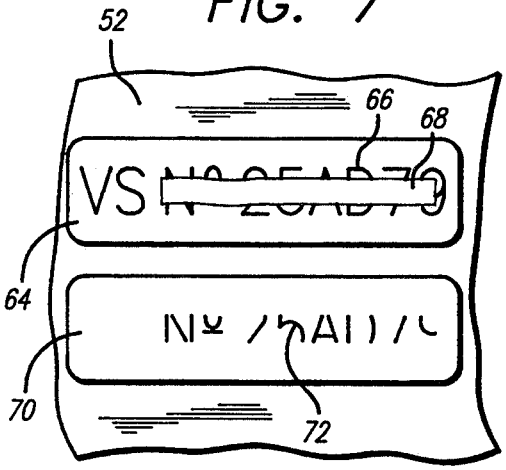
FIG. 7 is a front view showing a label affixed to goods which has been removed, leaving the weakened portion of the label affixed to the goods.

The patterned destrux varnish layer 38 is designed to produce a variable release of the graphics pattern established by the "GENU-GRAPHIC" pattern. This results in a pattern that resembles tearing. This is done to avoid having a segment of the label which separates forming sharp lines. Sharp lines are easily recognized, and are more easily matched to a substitute overlaying label than an irregular tearing pattern. An example of the tearing pattern is shown in FIGS. 6 and 7. In addition, the "GENU-GRAPHIC" pattern is formed of a silicon based varnish which is applied in a manner similar to ink printing. This silicon based varnish exhibits poor adhesion characteristics to the clear acrylic adhesive layer 36. By inserting the destrux varnish layer 38 in between the clear acrylic adhesive layer 36 and the "GENU-GRAPHIC" layer 40, the poor adhesion characteristics of the silicon based varnish are counteracted.

Below the "GENU-GRAPHIC" layer 40 is a clear ultraviolet curable leveling primer layer 42. Avery Dennison Clear Primer AC518 or the equivalent is acceptable. Below the leveling primer layer 42 is a white pigmented pressure sensitive, ultra cross-linked acrylic adhesive layer 44. This acrylic adhesive layer 44 is mildly aggressive when first applied to a product in order to allow repositioning of the label 12 once it is applied to a product. This adhesive characteristic becomes increasingly aggressive as label 12 left applied to a product. The acrylic adhesive layer 44 has high shear characteristics, temperature resistance up to approximately 200° C., and leaves a residue producing a footprint which appears bluish-white when illuminated with a 365 nanometer (nm) blacklight source.

This label is placed on a bleached paper liner equipped with a release coating 18 in order to facilitate distribution and ease of use.

Bleached paper liner with a release coating 18 is a standard kraft bleached paper liner and can abe purchased in conjunction with Ultra adhesive layer 44 available as UHA1182 without titanium oxide (TiO) powder applied from the specialty tape division of Avery Specialty Tape Division, Painesville, Ohio. This acrylic adhesive is also available from BASF or Ciba Giegy in the form of either a powder or gel.

One of the significant features of the present invention is that matt varnish 30, PET layer 32, acrylic adhesive layer 36, patterned destrux varnish layer 38, and leveling primer layer 42 are clear. This allows the printing which is present in "GENU-GRAPHIC" layer 40 to be visible against the background of adhesive layer 44. Additionally, the leveling primer layer 42 deadens the adhesive layer 44 in order to permit printing the "GENU-GRAPHIC" layer 40.

In alternative embodiment shown in FIG. 8, the matt varnish layer 30 of FIG. 4 has been removed, and the PET layer 82 serves as the top layer of the label. In this embodiment, a support tab 80 is preferably located so as to equally divide the label, creating two equal sized windows 84 and 85. It is recognized that the particular location of tab 80 can be varied as required by the particular application to enlarge or shrink the size of windows 84 and/or 85.

The PET layer 82 shown in the embodiment of FIG. 8 is preferably of a different material than the PET layer 32 shown in FIG. 4. In the embodiment shown in FIG. 8, layer 82 is a precoated polyester film manufactured by Dunmore. Tab 80 has a width of approximately 5 mm in this application. It is recognized that PET film 32 can be readily used in this application as well. Adhesive layer 86 is comprised of the same material as adhesive layer 36, and layer 88 and 38 are identical as are layers 90 and 40, 92 and 42, and 94 and 44.

The composition of the label of the present invention allows it to be readily removed from a sheet of labels as shown in FIGS. 1 and 2, and applied to a product such as automotive parts with ease. Following removal from backing sheet 18, the labels must be handled with reasonable care to avoid tearing the thin layer of material within tamper window 34. Before being affixed to a product, the labels of the present invention are reasonably sturdy and are not so fragile that they will tear or become unusable during normal handling.

Because of the favorable characteristics of the clear ultraviolet curable leveling primer layer 42, the label of the present invention can be removed from a product in the event that the label is attached by error. While this must be accomplished within a reasonable period of time after the label has been affixed to the product, this time period is not so short that correction of mismarking errors is unduly burdensome or impossible to achieve without destroying and replacing all of the labels affixed to an incorrect product.

The characteristics of ultraviolet curable matt varnish layer 30 are such that printing on the labels of the present invention, or marking the labels with a suitable inking device creates an essentially permanent marking on the surface of the label. This prevents remarking the labels of the present invention by erasing and rewriting the text applied to the label.

The "GENU-GRAPHIC" layer provides an authentication pattern on the surface of the label makes it difficult for a counterfeiter to readily and inexpensively duplicate the labels of the present invention in order to apply them to counterfeit products, and sell them as authentic. In addition, the authentication of the present invention using an authentication viewer can be readily used to detect attempts to remove the outer portion of one label, and place it around the tamper window 34 of another label. This provides an additional discouragement to those who may be involved with switching labels on products.

There has been described hereinabove a novel implementation of a tamper proof label. Those skilled in the art may make numerous uses of the inventive concepts of the above invention including varying the authentication layer and replacing the "GENU-GRAPHIC" imprinted layer with a substitute imprinted pattern. Machine readable characteristics may be readily added to the present invention. These may take the form of infrared or ultraviolet readable inks, magnetic inks, and the like. The particular materials employed in manufacturing the present labels may be substituted, including substitution of one or more of the layers of the present invention by using materials which may be more compatible with each other. For example, the clear acrylic adhesive 36 does not readily adhere to the "GENU-GRAPHIC" 40 which is printed on clear UV cured leveling primer layer 42. Patterned destrux varnish layer 38 assists in forming the composition of the label of the present invention by insulating clear acrylic stripping adhesive layer 36 from "GENU-GRAPHIC" layer 40. Should a suitable adhesive be developed, discovered, or made available in the future, the patterned destrux varnish layer 38 may no longer be necessary in order to achieve the characteristics exhibited by the labels of the present invention. Alternatively, the "GENU-GRAPHIC" ink layer may be formed differently. The destrux varnish layer 38 may at some point be incorporated into clear acrylic layer 36, or clear UV cured leveling primer 42.

Those skilled in the art may now make numerous uses of and departures from the described embodiment of the present invention without departing from the inventive concepts thereof which are defined solely by the scope of the following claims.

What is claimed:

1. A tamper proof label comprising:

a first layer consisting of an ultraviolet curable matt varnish;

a second layer consisting of a clear polyethylene teraphthalate film having a thickness substantially greater than the thickness of the ultraviolet curable matt varnish which is located above the clear polyethylene teraphthalate film, said clear polyethylene teraphthalate film oriented to form a support layer surrounding, or surrounded by a fragile layer in which the clear polyethylene teraphthalate film is not present;

a third layer consisting of a clear acrylic adhesive adhered to the lower surface of the clear polyethylene teraphthalate film, and located beneath the ultraviolet curable matt varnish in those areas in which the clear polyethylene teraphthalate film is not present;

a fourth layer consisting of a patterned destrux varnish layer located beneath the clear acrylic adhesive layer;

a fifth layer consisting of an authentication layer located beneath the patterned destrux varnish layer, said pattern destrux varnish layer causing said authentication layer to appear torn by variably releasing the authentication layer when the label is removed from an article or product to which it has been applied; and a pressure sensitive adhesive layer located below said authentication layer which bonds aggressively to products to which the label is affixed.

2. The label of claim 1 in which said authentication layer further consists of a line scrambled "GENU-GRAPHIC" layer.

3. The label of claim 1 and further including a backing sheet comprised of a paper liner with a release coating.

4. The label of claim 1 in which the pressure sensitive adhesive layer contains a white pigment, and the pressure sensitive adhesive is further characterized as an ultra cross-linked acrylic adhesive.

5. The label of claim 1 in which the pressure sensitive adhesive includes a pigment which leaves a residue once bonded to a product, said residue visible under ultraviolet, or alternatively under visible light.

6. A security label comprising:

a plastic sheet label having a window;

a backing sheet having a release layer thereon;

adhesive layer securing said plastic sheet to said backing sheet;

a varnish layer coextensive with said plastic sheet label; and graphics applied to said label and extending across said label both in the areas of said plastic sheet label enclosing the window and in the window area.

7. The label of claim 6 and further comprising a destrux layer extending within both said backing sheet and said plastic sheet and causing said backing sheet and said plastic sheet to exhibit characteristics resembling tearing when said support segment is separated from said fragile segment.

8. The label of claim 6 and further comprising an authentication indicia extending across both said backing sheet and said plastic sheet.

9. The label of claim 8 in which said authentication indicia further includes 2 distinct sets of text which are alternately viewable.

10. The label of claim 8 in which an authentication viewer is required to readily view and distinguish said authentication indicia.

11. The label of claim 6 in which said aggressive adhesive layer affixed to the bottom of said label is a gradually curing adhesive which when initially affixed to a product is mildly aggressive allowing repositioning or removal of the label without damage to said plastic sheet, and when cured is an extremely aggressive adhesive making separation of the label from the product difficult.

12. The label of claim 11 in which said fragile segment becomes substantially intimately bonded to a product or surface on which the label is placed, such that said plastic sheet is less aggressively bonded to said backing sheet than it is to the product or surface to which the label has been affixed.

13. The label of claim 6 in which said adhesive layer securing said plastic sheet to said backing sheet includes a pigment which leaves a residue once bonded to a product which is visible under illumination by an ultraviolet light source.

14. The label of claim 5 and further comprising:

a top layer consisting of an ultraviolet curable matt varnish having a thickness substantially less than the thickness of the clear polyethylene teraphthalate film and being located above said layer of said clear polyethylene teraphthalate film.

15. A tamper proof label comprising:

a support segment;

a in-situ formed fragile layer attached to said support segment, and easily separable therefrom;

an aggressive adhesive layer affixed to the back of the label, extending across both the support layer and the fragile layer, such that once the label is applied to a product, removal of the label will result in said fragile layer remaining affixed to said product, and in which the top of said fragile layer and said support layer consists of a curable coating selected from the group of materials consisting of varnish and epoxy; and said aggressive adhesive layer being a gradually curing adhesive, allowing the tamper proof label to be repositioned or removed from a product if such removal occurs within a short period of time after the tamper proof label is affixed to the product.

16. A tamper proof label comprising:

a support segment;

a in-situ formed fragile layer attached to said support segment, and easily separable therefrom;

an aggressive adhesive layer affixed to the back of the label, extending across both the support layer and the fragile layer, such that once the label is applied to a product, removal of the label will result in said fragile layer remaining affixed to said product, and in which the top of said fragile layer and said support layer consists of a curable coating selected from the group of materials consisting of varnish and epoxy; and an authentication layer extending across both the support layer and the fragile layer and providing a predetermined indicia of authentication of the label.

17. The label as described in claim 16 in which said authentication layer further includes an imprinted layer whose text can be viewed without difficulty only by using a compatible authentication viewer.

18. The label as described in claim 17 in which said authentication pattern includes two distinct patterns of text which are alternatively viewable using the authentication viewer.

19. A tamper proof label comprising:

a support segment;

a in-situ formed fragile layer attached to said support segment, and easily separable therefrom;

an aggressive adhesive layer affixed to the back of the label, extending across both the support layer and the fragile layer, such that once the label is applied to a product, removal of the label will result in said fragile layer remaining affixed to said product, and in which the top of said fragile layer and said support layer consists of a curable coating selected from the group of materials consisting of varnish and epoxy; and a destrux layer extending beneath both the support layer and the fragile layer, such that said destrux layer is variably released creating a tearing pattern when said support layer and said fragile layer are separated.

* * * * *